US005088157A

United States Patent [19]

Yasuda et al.

[11] Patent Number: 5,088,157

[45] Date of Patent: Feb. 18, 1992

[54] UNIT DRAFTING MECHANISM HAVING AIR JET APERTURED SLIDE METALS AND ROLLERS

[75] Inventors: Hironori Yasuda, Inazawa; Yoshiharu Tomoto, Gifu, both of Japan

[73] Assignee: Howa Machinery, Ltd., Nagoya, Japan

[21] Appl. No.: 592,082

[22] Filed: Oct. 3, 1990

[30] Foreign Application Priority Data

Oct. 3, 1989 [JP] Japan ..... 1-258271

[51] Int. Cl.[5] ..... D01H 5/66

[52] U.S. Cl. ..... 19/263; 19/245

[58] Field of Search ..... 19/107, 218, 236, 245, 19/262, 263, 264, 278; 57/300, 304, 305

[56] References Cited

U.S. PATENT DOCUMENTS

| | | | |
|---|---|---|---|
| 2,719,333 | 10/1955 | Buchanan | 19/263 X |
| 2,934,797 | 5/1960 | Whitehurst et al. | 19/263 X |
| 3,074,121 | 1/1963 | Barr et al. | 19/263 |
| 3,141,203 | 7/1964 | Whitehurst et al. | 19/263 |
| 3,237,249 | 3/1966 | Aurich | 19/245 |
| 3,247,551 | 4/1966 | Whitehurst | 19/263 X |
| 3,251,100 | 5/1966 | Ingham | 19/263 |

FOREIGN PATENT DOCUMENTS

| | | | |
|---|---|---|---|
| 1926419 | 5/1969 | Fed. Rep. of Germany | 19/263 |
| 56-23337 | 11/1982 | Japan . | |
| 57-188884 | 11/1982 | Japan . | |
| 0211631 | 11/1984 | Japan | 19/245 |
| 1252323 | 11/1986 | Japan | 19/263 |
| 62-191522 | 8/1987 | Japan . | |

*Primary Examiner*—Werner H. Schroeder
*Assistant Examiner*—Ismael Izaguirre
*Attorney, Agent, or Firm*—Dennis H. Lambert

[57] ABSTRACT

A unit drafting mechanism of a spinning machine, having at least one unit drafting mechanism and provided with a pair of slide metals disposed on roller stands facing each other, and a plurality of bottom rollers and top rollers journaled on these slide metals in a rotatable condition, wherein each bottom roller is provided with an axial air passage formed coaxially with its center axis, air jet apertures are radially formed at both end portions near the bearing bores of the slide metals, each aperture is connected to the axial air passage, and the axial air passage is connected to a source of compressed air, whereby the possible deposition of flies in the circumference around the journal portions of the draft rollers can be effectively eliminated by continuously or intermittently supplying compressed air through the axial air passage of the bottom rollers.

10 Claims, 4 Drawing Sheets

UNIT DRAFTING MECHANISM HAVING AIR JET APERTURED SLIDE METALS AND ROLLERS

BACKGROUND OF THE INVENTION

1. Field of the Invention

The present invention relates to a drafting mechanism and, more specifically, to an improvement of a unit drafting mechanism to be incorporated into a spinning machine such as a drawing frame, a comber, or a lap former, for doubling and roller-drafting slivers.

2. Description of the Related Art

As is generally known, in a conventional drafting mechanism for a spinning frame, such as a drawing frame, a pair of slide metals are disposed on the roller stands facing each other. A plurality, for example, three or four, of bottom rollers and top rollers are journaled on these slide metals and clearer pads are disposed at positions below corresponding bottom rollers in contact thereto and swing in a direction along the delivering direction of slivers supplied to the drawing frame. An Ermen's clearer provided with an endless clearing belt is rotatably disposed above the top rollers in contact thereto so that flies adhered to the top rollers and the bottom rollers can be removed therefrom. As disclosed in Japanese Examined Utility Model Publication (KOKOKU)No. 56-23337 and Japanese Unexamined Utility Model Publication (KOKAI)No. 57-188884, a conventional bottom roller has a fluted working section, journals supported in bearings on the slide metals, and cylindrical neck sections formed between the fluted working section and the corresponding one of the journals. A conventional top roller has a smooth working section provided with a smooth cylindrical surface extending between the slide metals and facing the fluted working section of the corresponding bottom roller.

The working section of the bottom roller of the conventional drafting mechanism is provided with many flutes extending along the axial direction thereof and formed in the circumferential portion thereof in a substantially parallel condition. When the drafting mechanism is driven at high speed, an accompanying air stream is created at a portion around the facing top roller and bottom roller by high speed rotation of the rollers. Most of the accompanying air stream tends to flow in the axial direction along the contact line between the top rollers and bottom roller and along the line of contact of the working sections of the top and bottom rollers and the clearer members. Accordingly, when such an accompanying air stream passes the end portions of the roller, it disperses around the neck portions of the top roller and the bottom roller together with flies. Such flies adhere to the neck portions of these rollers and finally are introduced into a fiber fleece being processed by the drafting mechanism. This phenomenon has been recognized as a serious problem impairing the quality of slivers delivered from such a drafting mechanism.

The applicants of the present application proposed previously a drafting mechanism capable of intercepting such accompanying axial air flows to prevent the disturbance of the smooth arrangement of fibers in the processing fleece, as disclosed in Japanese Unexamined Patent Publication (KOKAI)No. 62-191522. This drafting mechanism employs top and bottom rollers having working sections of lengths substantially equal to the distance between the slide metals and intercepts the accompanying axial air flows by the inside surfaces of the slide metals.

However, this known, improved drafting mechanism still has drawbacks in that the accompanying axial air flows flowing toward the opposite ends of the working sections carry flies into gaps between the journals of the bottom roller and the corresponding bearings to cause seizure. Further, flies aggregate around the slide metals and around the circumference of the top and bottom rollers and drop into the processing fleece to impair the quality of the slivers in process. Furthermore, when rotated at a high speed, the bottom roller is heated by friction and damages the rubber coating of the top roller or adversely affects the quality of the fleece.

SUMMARY OF THE INVENTION

The present invention has been made with the intention of improving the quality of slivers and enhancing the operating speed of the spinning machine by solving the problems caused by the high speed rotation of the bottom rollers. It is therefore an object of the present invention to provide an improvement of a unit drafting mechanism of a spinning machine, such as a drawing frame provided with at least one unit drafting mechanism, which effectively solves the problems due to the accompanying air flows created in the portion surrounding the top rollers and the bottom rollers when the drafting mechanism is driven at a high speed.

To attain the above-mentioned object, the present invention provides an improvement of a unit drafting, mechanism of a spinning machine, having at least one unit drafting mechanism, provided with a pair of slide metals disposed on roller stands facing each other and a plurality of bottom rollers and top rollers journaled on these slide metals in a rotatable condition, each roller having a working section of a length substantially corresponding to the distance between the inside surfaces of the slide metals. In this improvement, each bottom roller is provided with an axial air passage formed coaxially with its center axis, air jet apertures are radially formed at both end portions near to the bearing bores of the slide metals, while each aperture is connected to the axial air passage, and the axial air passage is connected to a source of compressed air.

The amount of the air flow generated around the top and bottom rollers due to the high speed rotation of the top and bottom rollers and axially flowing along the line of contact of the top and bottom rollers is reduced remarkably by the inside surfaces of the slide metals. Compressed air supplied continuously or intermittently from the supply source thereof through the axial air passage of the bottom roller is jetted through the radial air jet nozzles onto the bearing bores of the slide metals. The compressed air flows continuously or intermittently through gaps between the journals of the bottom roller and the bearing bores of the slide metals into spaces on the inner side of the slide metals. The adhesion of flies to and accumulation of the same on the necks and journals of the top and bottom rollers and the slide metals can be prevented by blowing away the flies in the vicinity of the inside surfaces of the slide metals and those adhering to the circumference of the bottom roller and the slide metals.

The continuous or intermittent elimination of flies from the circumference of the bottom roller by compressed air prevents aggregates of flies from falling into the processing fleece, so that the slivers can be drafted in a satisfactory condition without impairment of the quality thereof. Hence, the spinning machine is able to operate at a delivery speed of sliver as high as, for example, 1.5 times the sliver delivery speed of a spinning machine provided with a conventional drafting mechanism.

Moreover, the bottom rollers are cooled by the compressed air supplied through the axial air passage and the radial air jet apertures formed in each bottom roller.

DESCRIPTION OF THE PREFERRED EMBODIMENTS

As is well known, the latest conventional drawing frames are provided with single or double deliveries, or in other words, a single drafting mechanism or two drafting mechanisms. For the sake of better understanding of the present invention, the construction and function of the invention are hereinafter explained by embodiments provided with a single drawing mechanism. The invention, however is not limited to this.

Figure 1:
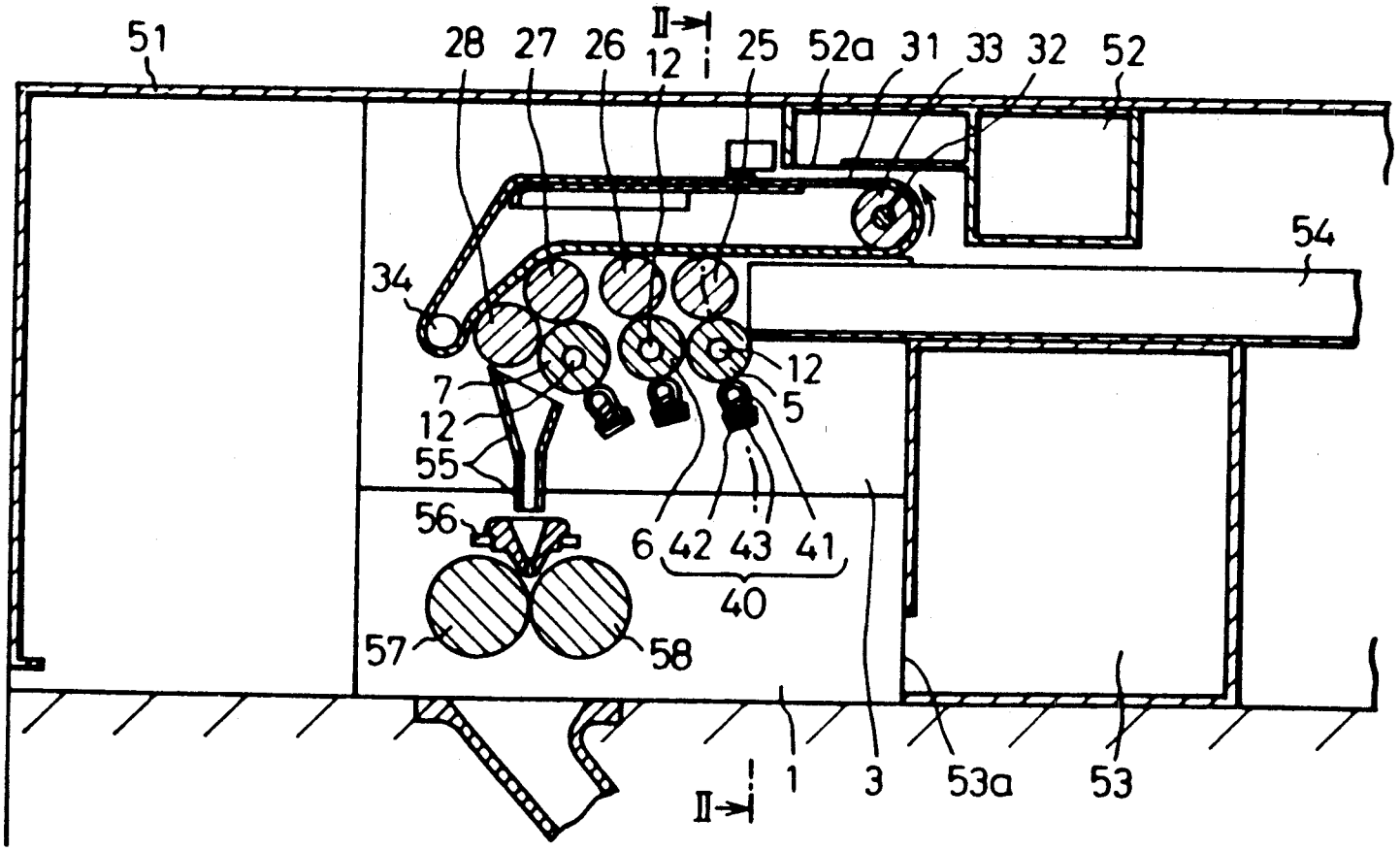
FIG. 1 is a side elevation of a drafting mechanism of the present invention, showing parts in section.
Figure 2:
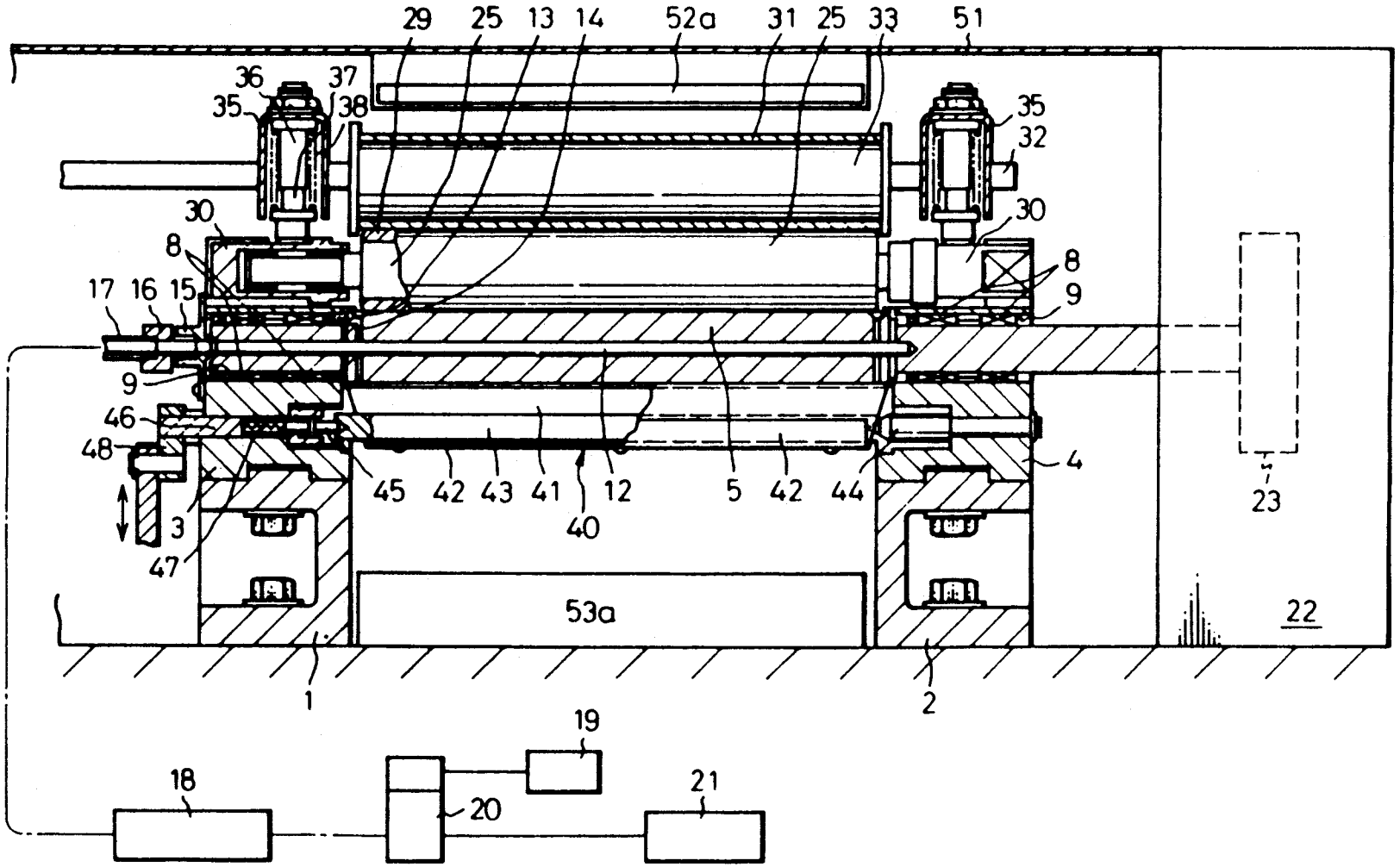
FIG. 2 is a sectional view of a typical embodiment of a unit drafting mechanism of the present invention taken along the line 1I—1I in FIG. 1.
Figure 3:
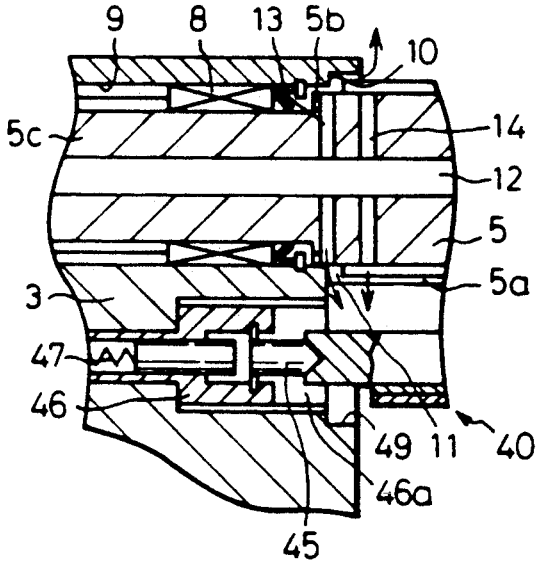
FIG. 3 is an enlarged sectional view of a bottom roller bearing unit utilized for the drafting mechanism shown in FIG. 1.

Referring to FIGS. 1, 2 and 3, a pair of roller stands 1 and 2 of a drafting mechanism incorporated into a drawing frame are bolted to a beam. Slide metals 3 and 4 are bolted respectively to the roller stands 1 and 2. The positions of the slide metals 3 and 4 are adjustable in a direction perpendicular to the plane of the paper as viewed in FIG. 2 . Bottom rollers 5, 6, and 7 are supported for rotation in needle bearings 8 on the slide metals 3 and 4. Since the bottom rollers 5, 6, and 7 are substantially the same in the construction and function of the journal portions in relation to the slide metals 3 and 4, the following explanation takes up the construction and function of the bottom rollers in relation to the slide metals 3 and 4.

As shown in FIGS. 1 and 2, the bottom roller 5 is formed by a fluted working section 5*a*, a pair of journal portions 5*c* formed at both end portions, and cylindrically stepped portions 5*b* formed between the fluted working section 5*a* and the journal portions 5*c*. The cross-sectional diameter of the cylindrically stepped portion 5*b* is identical to a cross-sectional diameter of an imaginary cylinder defined by the bottom lines of the flutes of the fluted working section 5*a* and is larger than the cross-sectional diameter of the journal portions 5*c*. The axial length of the stepped portions 5*b* is very short as shown in FIG. 2. Of course, the working section 5*a*, the stepped portions 5*b*, and the journal portions 5*c* have a common axis. The end portions of the stepped portion 5*b* and the end portions of the fluted working section 5*a* at both sides of the bottom roller 5 are hereinafter referred to as shoulder portions of the bottom roller 5.

Each of the slide metals 3 and 4 is provided with a bore to receive the corresponding journal portion 5*c* of the bottom roller 5 via a needle bearing 8. Each of the slide metals 3 and 4 is provided with cylindrical recesses 10 which receives the shoulder portions of the bottom roller 5 with a small annular gap 11. That is, the cylindrical recesses of the slide metals 3 and 4 are provided with stepped profile which match the outside profiles of the shoulder portions of the bottom roller so that the stepped annular gap 11 is formed, as shown in FIGS. 1, 2, and 3.

An axial air passage 12 is formed through the bottom roller 5 around the center axis thereof. Radial air jet apertures 13 and 14 are formed on each shoulder portion of the bottom roller 5. That is, the air jet apertures 13 are formed in the cylindrical stepped portions 5*b* in such condition that a pair of oppositely directed apertures 13 are formed along a line crossing the axial center of the bottom roller 5 in perpendicular relationship thereto, while the air jet apertures 14 are formed in the fluted working sections 5*c* at the end portions thereof in such condition that a pair of oppositely directed apertures 14 are formed along a line crossing the axial center of the bottom roller 5 in perpendicular relationship thereto. As clearly shown in FIG. 3, the air jet apertures 13 direct to the annular gap 11 between the inside surface of the cylindrical recess 10 and the stepped portion 5*b*, while the air jet apertures 14 direct to the annular edge of the corresponding one of the slide metals 3 and 4. Since air jet apertures 13 and 14 are communicated with the axial air passage 12, therefore, an air jet can be supplied into the above-mentioned annular gap 11 and the inside edge portions of the slide metals 3, 4, respectively, through the air jet apertures 13 and 14.

The radial air jet apertures 13 and 14 may be inclined with respect to the axis of the bottom roller 5. Also while this embodiment shows two radial air jets 13 and 14, more than two radial air jets 13 and 14 may be formed in each shoulder portion of the bottom roller 5. A nozzle 15 is fastened to the slide metal 3 with screws so as to close the outer end of the bearing bore 9, and a pipe fitting 16 is screwed in the nozzle 15. An air supply pipe 17 has one end connected to the pipe fitting 16 and the other end connected to an air source 21 and is provided with a flow regulator valve 18 and an on-off solenoid valve 20. The solenoid valve 20 is controlled by a timer 19. The bottom roller 5 is driven for rotation through a gear 23 included in a gearing contained in a gear box 22.

Top rollers 25, 26, 27, and 28 each coated with a rubber coating 29 are supported for rotation in needle bearings fitted in bearing bushes 30, respectively. The bearing bushes 30 are fitted for vertical sliding movement in grooves formed in the slide metals 3 and 4. The working sections of the top rollers 25 and 26, 27, and 28 are in contact with the working sections of the corresponding bottom rollers 5, 6, and 7, respectively, to form a drafting mechanism. An Ermen's clearer 31 is provided which comprises a driving roller 33 mounted on a driving shaft 32 which is driven for intermittent rotation in the direction of the arrow in FIG. 1, a guide roller 34, and an endless clearing belt extended between the driving roller 33 and the guide roller 34. The Ermen's clearer 31 is disposed with the bottom side of the endless clearing belt in contact with the upper surfaces of the top rollers 25, 26, 27, and 28. The endless clearing belt of the Ermen's clearer 31 has a width sufficient to contact the entire length of the working sections 5*a* of the top rollers 25, 26, 27, and 28 and to extend substantially entirely over the space between the slide metals 3 and 4. The guide roller 34 is journaled on top arms 35 rotatably joined to the opposite ends of the driving shaft 32 to enable the Ermen's clearer 31 to be turned upward on the driving shaft 32. A spring 38 is extended between each of bushes 36 attached to each top arm 35 and each of pressures pins 37 slidably fitted in the bushes 36. When placed in an operating position, the Ermen's clearer 31 presses the bearing bushes 30 supporting the top rollers 25, 26, 27, and 28 resiliently through the springs 38 to press the working sections of the top rollers 25, 26, 27, and 28 against the working sections of the bottom rollers 5, 6, and 7.

A clearer bar 40 is assembled by fastening a clearing pad 41 to a support bar 43 with a pad holding member 42. Support pins 44 and 45 engage center apertures formed in the opposite ends of the support bar 43 to support the clearer bar 40. The support pin 45 is slidably fitted in a bore formed in a pin holder 46 fitted in the slide metal 3 and is biased so as to project from the pin holder 46 by a coil spring 47. The left-hand end of the support bar 43 is fitted in a slot 46*a* formed in the extremity of the pin holder 46, and a crank mechanism, not shown, swings a swing lever 48 attached to the pin holder 46 to swing the clearer bar 40. The clearer pads 41 of the clearer bars 40 have a length sufficient to contact the entire lower surfaces of the working sections 5*a* of the bottom rollers 5, 6, and 7, respectively. Recesses 49 of a depth substantially the same as that of the recesses 10 for receiving the shoulder portions of the bottom rollers 5, 6, and 7 are formed in the slide metals 3 and 4 to allow the swing motion of the clearer pads 41. Each clearer bar 40 can readily be removed from the slide metals 3 and 4 by simply compressing the coil spring 47. During operation, the drafting mechanism thus constructed is covered with a cover 51. A top suction duct 52 having a suction opening 52*a* and a bottom suction duct 53 having a suction opening 53*a* are provided within the cover 51 to suck air prevailing within the cover. In FIG. 1, a sliver feed table 54, a fleece guide 55, a condenser 56, and calender rollers 57, 58 are shown.

The drafting mechanism drafts a predetermined number of slivers fed along the sliver feed table 54 at a predetermined draft ratio. A fleece formed by drafting the slivers is collected by the fleece guide 55, and the collected fleece is delivered by the calender rollers 57 and 58. During this drafting operation, the endless clearer belt of the Ermen's clearer 31 is turned intermittently and clearer bars 40 are swung to clear flies adhered to the top and bottom rollers. The air prevailing within the cover 51 is sucked together with flies through the top suction duct 52 and the bottom suction duct 53 to discharge the flies from the cover 51. Since the working sections of the bottom rollers 5, 6 and 7 are fluted, the large amount of air adjoining the working sections of the bottom roller 5 and containing flies tend to flow axially when the bottom rollers 5, 6 and 7 are rotated at high rotating speeds. Accordingly, the flies tend to adhere to the opposite ends of the working sections of the bottom rollers 5, 6, and 7 and the top rollers 25, 26, 27, and 28 and to the inside surfaces of the slide metals 3 and 4. Since the working sections of each bottom roller and each top roller extend fully over the distance between the inside surfaces of the slide metals 3 and 4 and are in entire contact with the clearer pad 41 of the clearer bar 40 and the endless clearer belt of the Ermen's clearer, and since the axial air flows adjoining the working sections of the bottom roller 5 and the top roller 25 are stopped by the inside surfaces of the slide metals 3 and 4, the velocity of the air flows is weakened. Furthermore, the solenoid valve 20 is opened for several seconds by the timer 19 at regular time intervals, for example, time intervals of several minutes, which are determined according to the type of the material fibers, such as cotton fibers, synthetic fibers or mixed fibers, to jet compressed air supplied from the air source 21 through the radial air jets 13 and 14. Consequently, flies adhering to the shoulder portions of the working sections of each bottom roller and each top roller and to the inside surfaces of the slide metals 3 and 4 are blown off and are sucked together with air into the suction ducts 52 and 53. However, since the bottom rollers of the first embodiment are provided with the particular construction as already explained about the bottom roller 5, the following phenomenon is created in the shoulder portions of each one of bottom rollers 5, 6 and 7 as hereinafter explain about the bottom roller 5. That is, the air jetted through the radial air jets 13 flows through the annular stepped gaps 11 in all radial directions to expel short fibers and flies away from the journals of the bottom roller 5. The air jetted through the radial air jet apertures 14 flows at a high velocity in all radial directions to blow flies far away from the bottom roller 5.

Figure 4:
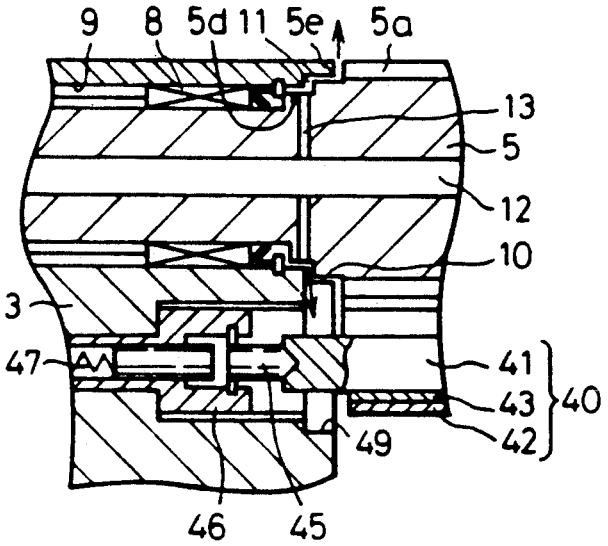
FIGS. 4, 5, and 6 are enlarged sectional views of bottom roller bearing units employed in other embodiments according to the present invention.
Figure 5:
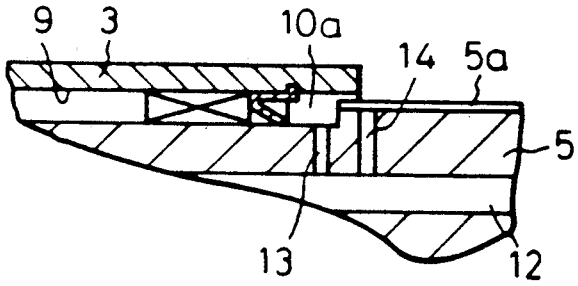

In a modification shown in FIG. 4, the radial air jet apertures 14 are omitted, and the bottom roller 5 is provided with only the axial air passage 12 and a pair of air jet apertures 13, which are formed along a line crossing the axial center of said bottom roller perpendicularly thereto and in a condition of being directed to said space at a position between said intermittent portion connected to said end portion of said fluted working section of said bottom roller and said annular recess. Accordingly, the jet air escapes through the corresponding gap between the end of the slide metal 3 or 4 and the corresponding shoulder portion of the bottom roller 5. In this modification, the cylindrical stepped portion 5*b* is changed to two cylindrical stepped portions 5*a*, 5*e* as shown in FIG. 4. The shape of the annular gap 11 is also changed to fit this change. The air jetted through the radial air jet apertures 13 flows through the stepped gaps 11 and disperses around the circumference of the shoulder portions of the bottom roller at a comparatively low velocity. Accordingly, it is practically preferable to jet air continuously through the radial air jet apertures 14. In a modification shown in FIG. 5, the bottom roller 5 is not provided with the stepped shoulder portion(s) 5*b*(5*d*, 5*e*) of the above-mentioned embodiments. Each end of the working section 5*a* of the bottom roller 5 is located in the bearing bore 9 to form an annular space 10*a* instead of the recess 10.

Figure 6:
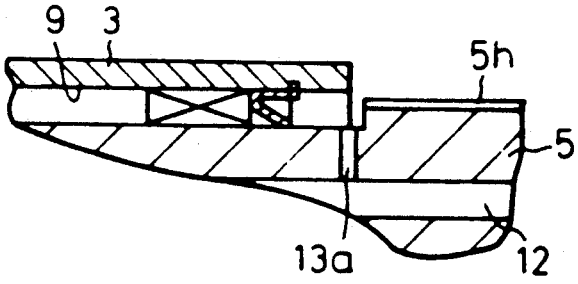

Referring to FIG. 6 showing a drafting mechanism in another embodiment according to the present invention, each end of the working section 5*k* of a bottom roller 5 is located near to the inner end of the bearing bore 9, and radial air jet apertures 13*a* are formed so as to be located opposite to the inner edge of the bearing bore 9. Therefore, in this embodiment, the end portions of the fluted working section 5*a* of the bottom roller 5 are omitted from the constructional meaning of the shoulder portion explained in the other embodiments of the present invention. As the other embodiments, part of the air jetted through the radial air jet apertures 13*a* flows into the bearing bore 9 and then out of the bore 9. The rest of the air jetted through the radial air jet apertures 13*a* flows along the inside surface of the slide metal 3 to prevent the adhesion of flies to the inside surface of the slide metal 3.

Although the invention has been described in its preferred forms with a certain degree of particularity, obviously many changes and variations are possible therein. For example, in the case of applying the present invention to a drawing frame provided with two drafting mechanisms, the central axial air passages of two bottom rollers having identical functions are connected to each other so that compressed air can be supplied from the supply source to the combination of the central axial air passages from one side of the drawing frame. It is therefore to be understood that the present invention may be worked other wise than as specifically described herein without departing from the scope and spirit thereof.

We claim:

1. A unit drafting mechanism of a spinning machine provided with at least one unit drafting mechanism, wherein a pair of slide metals are disposed on roller stands facing each other, a plurality of bottom rollers and top rollers are journaled on said slide metals in a rotatable condition, each one of said bottom rollers provided with a fluted working section of a length substantially corresponding to a distance between inside surfaces of said slide metals, a pair of journal portions are rotatably supported by said slide metals, and a pair of shoulder portions, each thereof provided with an intermittent portion between a corresponding end portion of said fluted working section and a corresponding one of said journal portions, comprising:

a cylindrical recess formed at an inside position of each one of said slide metals for receiving a corresponding shoulder portion of said bottom roller with an annular gap therebetween, an axial air passage formed along an axis center of each said bottom roller, at least one air jet aperture radially formed at each of said shoulder portions thereof in a direction facing said gap between said cylindrical recess and said shoulder portion, each one of said air jet apertures connected to said axial air passage, a compressed air supply source to supply compressed air to said axial air passage of each one of said bottom rollers, and means for connecting said compressed air supply source to said axial air passage of each one of said bottom rollers.

2. The unit drafting mechanism of a spinning machine according to claim 1, wherein said connecting means is provided with a mechanism for continuously supplying said compressed air to said axial air passages.

3. The unit drafting mechanism of a spinning machine according to claim 1, wherein said connecting means is provided with a mechanism for intermittently supplying said compressed air to said axial air passages.

4. The unit drafting mechanism of a spinning machine according to claim 1, wherein said shoulder portion extends to a corresponding end portion of said fluted working section.

5. The unit drafting mechanism of a spinning mechanism according to claim 4, wherein said shoulder portion of said bottom roller is provided with a stepped profile defined by the profile of the fluted working section of said bottom roller and the profile of said intermittent portion, and has a cross-sectional diameter equal to a cylindrical projection of a circle defined by the bottom of the flutes of said fluted working section, and said cylindrical recess of said slide metal is provided with a stepped profile sized and shaped for receiving said profile of said shoulder portion of said bottom roller with a substantially uniform space against said profile of said shoulder portion of said bottom roller.

6. The unit drafting mechanism of a spinning machine according to claim 5, wherein at each end-side of said bottom roller, a pair of said air jet apertures are formed along a transverse line crossing the axial center of said bottom roller and directed to an inside edge of a corresponding one of said slide metals at each end portion of said fluted working section, while a pair of said air jet apertures are formed along a transverse line crossing the axial center of said bottom roller and directed to said space at a position between said intermittent portion connected to said end portion of said fluted working section of said bottom roller and said cylindrical recess.

7. The unit drafting mechanism of a spinning machine according to claim 5, wherein one of said air jet apertures faces said space between each one of said intermittent portions of said bottom roller and said cylindrical recess of said slide metal.

8. The unit drafting mechanism of a spinning machine according to claim 4, wherein said shoulder portion is provided with a stepped profile defined by a profile of said end portion of said fluted working section of said bottom roller and a profile of said intermittent portion and has cross-sectional diameter identical to that of said journal potion.

9. The unit drafting mechanism of a spinning machine according to claim 8, wherein at each end-side of said bottom roller, a pair of said air jet apertures are formed along a transverse line crossing the axial center of said bottom roller and directed to an inside edge of a corresponding one of said slide metals at each end portion of said fluted working section, and a pair of said air jet apertures are formed along a transverse line crossing the axial center of said bottom roller and directed to said space at a position between said intermittent portion connected to said end portion of said fluted working section of said bottom roller and said cylindrical recess.

10. The unit drafting mechanism of a spinning machine according to claim 8, wherein at each end-side of said bottom roller, each said end portion of said fluted working section of said bottom roller is located outside of said annular recess of said slide metal, a pair of said air jet apertures are formed along a line crossing the axial center of said bottom roller and directed to said space between said intermittent portion and said cylindrical recess at each side of said bottom roller.

* * * * *